US009819090B2

(12) United States Patent
Nitch et al.

(10) Patent No.: US 9,819,090 B2
(45) Date of Patent: Nov. 14, 2017

(54) ANTENNA WITH DIVERGING ANTENNA ELEMENTS

(71) Applicant: POYNTING ANTENNAS (PTY) LIMITED, Sandton (ZA)

(72) Inventors: Derek Colin Nitch, Witkoppen (ZA); Andries Petrus Cronje Fourie, Johannesburg (ZA)

(73) Assignee: POYNTING ANTENNAS (PTY) LIMITED, Samrand (ZA)

( * ) Notice: Subject to any disclaimer, the term of this patent is extended or adjusted under 35 U.S.C. 154(b) by 0 days.

(21) Appl. No.: 14/432,605

(22) PCT Filed: Jan. 7, 2013

(86) PCT No.: PCT/IB2013/050126
§ 371 (c)(1),
(2) Date: Mar. 31, 2015

(87) PCT Pub. No.: WO2014/053919
PCT Pub. Date: Apr. 10, 2014

(65) Prior Publication Data

US 2015/0244076 A1 Aug. 27, 2015

(30) Foreign Application Priority Data

Oct. 5, 2012 (ZA) ..... 2012/07480

(51) Int. Cl.
*H01Q 9/46* (2006.01)
*H01Q 1/08* (2006.01)
(Continued)

(52) U.S. Cl.
CPC ..... *H01Q 9/46* (2013.01); *H01Q 1/08* (2013.01); *H01Q 9/10* (2013.01); *H01Q 9/28* (2013.01); *H01Q 9/44* (2013.01)

(58) Field of Classification Search
CPC .. H01Q 9/08; H01Q 9/10; H01Q 9/44; H01Q 9/46; H01Q 1/08
See application file for complete search history.

(56) References Cited

U.S. PATENT DOCUMENTS 2,985,877 A * 5/1961 Holloway ..... H01Q 9/28 343/809
3,950,758 A 4/1976 Mirrione et al.
(Continued)

FOREIGN PATENT DOCUMENTS

WO WO 2005/011050 2/2005
WO WO 2009/146326 12/2009

OTHER PUBLICATIONS

International Search Report for PCT/IB2013/050126 dated May 31, 2013, 3 pages.
(Continued)

*Primary Examiner* — Jessica Han
*Assistant Examiner* — Daniel J Munoz
(74) *Attorney, Agent, or Firm* — Nixon & Vanderhye P.C.

(57) ABSTRACT

An antenna 10 comprises at least a first pair 12 of elongate radiating elements and a second pair 14 of elongate radiating elements. Each pair comprises a first element 12.1 and a second element 12.2. Each element has a feed end 12.11 and a distal end 12.12. The first and second elements of each of the at least first pair and second pair have their respective feed ends 12.11, 12.21 in juxtaposition relative to one another and extend in diverging relationship relative to one another in a direction from their feed ends towards their distal ends. The at least first and second pairs are electrically connected in parallel. In some embodiments the elements may diverge exponentially. The invention also relates to
(Continued)

antennas which may be packaged in at least partially knock-down form to be assembled or deployed conveniently at a user site.

19 Claims, 11 Drawing Sheets

(51) Int. Cl.

| | |
|---|---|
| ***H01Q 9/10*** | (2006.01) |
| ***H01Q 9/28*** | (2006.01) |
| ***H01Q 9/44*** | (2006.01) |

(56) References Cited

U.S. PATENT DOCUMENTS

| | | | | |
|---|---|---|---|---|
| 4,308,540 | A | 12/1981 | Winegard et al. | |
| 4,568,944 | A * | 2/1986 | Cassel | H01Q 1/38 343/802 |
| 4,633,265 | A * | 12/1986 | Wheeler | H01Q 9/44 343/797 |
| 2002/0109643 | A1 * | 8/2002 | Buckles | H01Q 9/46 343/893 |
| 2002/0171599 | A1 | 11/2002 | Palmer et al. | |
| 2009/0295668 | A1 * | 12/2009 | Nilsson | H01Q 9/28 343/840 |

OTHER PUBLICATIONS

Written Opinion of the International Searching Authority for PCT/IB2013/050126 dated May 31, 2013, 6 pages.

* cited by examiner

ANTENNA WITH DIVERGING ANTENNA ELEMENTS

This application is the U.S. national phase of International Application No. PCT/IB2013/050126, filed 7 Jan. 2013 which designated the U.S. and claims priority to South Africa Patent Application 2012/07480 filed 5 Oct. 2012, the entire contents of each of which are hereby incorporated by reference.

INTRODUCTION AND BACKGROUND

This invention relates to an antenna. The invention also relates to an antenna which may be packed and transported in a knock-down form and then conveniently be assembled.

One application for broadband antennas covering a frequency band extending between about 470 MHz and about 840 MHz, is for receiving television broadcasts at a user premises or site. Two currently known antennas for this purpose are a log periodic and bowtie with grid reflector. Aesthetically the grid may not be acceptable for some applications and/or customers. Furthermore, the known antennas are often also too cumbersome to install and may be too expensive for some applications and/or customers. Still furthermore, the known antennas are too heavy and/or too bulky and therefore take up unnecessary space, especially when packed for transportation.

OBJECT OF THE INVENTION

Accordingly, it is an object of the present invention to provide an antenna with which the applicant believes the aforementioned disadvantages may at least be alleviated or which may provide a useful alternative for the known antennas.

SUMMARY OF THE INVENTION

According to the invention there is provided an antenna comprising:

at least a first pair of elongate radiating elements and a second pair of elongate radiating elements, each pair of elongate radiating elements comprising a first radiating element and a second radiating element, each radiating element having a feed end and a distal end;

the first and second radiating elements of each of the at least first pair of elongate radiating elements and second pair of elongate radiating elements having their respective feed ends in juxtaposition relative to one another and extending in diverging relationship relative to one another in a direction from their respective feed ends towards their respective distal ends; and the at least first pair of elongate radiating elements and second pair of elongate radiating elements being electrically connected in parallel.

It is well known that antennas are reciprocal devices which may be used for either transmitting signals or receiving signals or both. It will hence be appreciated that when in this specification any term is used in one context, for example in a receiving context, where appropriate the term must be construed to include the term in the reciprocal context of transmitting.

A spine may be provided adjacent the feed ends of the radiating elements.

In some embodiments, the at least first pair of elongate radiating elements and second pair of elongate radiating elements may be oriented relative to the spine to be located in respective planes which extend parallel to one another.

In other embodiments, the at least first pair of elongate radiating elements and second pair of elongate radiating elements may be oriented relative to the spine to be located in respective planes which are diverging away from one another in a direction away from the spine.

The first and second radiating elements of each of the at least first pair of elongate radiating elements and second pair of radiating elements may extend in diverging relationship such that at points on a centre line between the first and second radiating elements, a ratio ($\underline{b}/\underline{a}$) of a transverse distance $\underline{b}$ between the first and second radiating elements through the point and a distance $\underline{a}$ from the feed ends to the point is constant.

Alternatively, the radiating elements of each of the at least first pair of elongate radiating elements and second pair of radiating elements may be curved and extend in diverging relationship such that at points on a centre line between the first and second radiating elements, a ratio ($\underline{b}/\underline{a}$) of a transverse distance $\underline{b}$ between the first and second radiating elements through the point and a distance $\underline{a}$ from the feed ends to the point, increases. The ratio may increase in one of a linear manner and a non-linear manner. In some embodiments, the ratio may increase exponentially.

At least the first radiating element of at least one pair of the at least first pair of elongate radiating elements and second pair of radiating elements may be removably mountable on the spine.

Said first radiating element at the feed end thereof may comprise a formation configured to cooperate with a cooperating formation on the spine collectively to effect said diverging relationship with the second radiating element of said at least one pair of radiating elements and said orientation of said at least one pair of radiating elements relative to the spine.

The formation at the feed end of said first radiating element may be formed integrally with said first radiating element and the cooperating formation may be formed integrally formed with the spine.

In some embodiments, all the radiating elements of the at least first pair of radiating elements and second pair of radiating elements may be identical in shape and configuration.

Further according to the invention, at least one of a) the spine and b) at least one radiating element may be manipulatable between a collapsed configuration and an operative configuration.

For example, the at least one radiating element may comprise a first segment and at least a second separate segment and the at least second separate segment may be removably connectable to the first segment in an end to end relationship.

In other embodiments, the at least one radiating element may comprise a first segment and at least a second segment which is permanently connected to the first segment and wherein the first segment and the at least second segment are manipulatable between the collapsed configuration and the operative configuration.

In still other embodiments, the at least one radiating element may be resiliently flexible along at least part of its length and biased towards the operative configuration, which may be curved.

According to another aspect of the invention there is provided an antenna comprising:

at least a first pair of elongate radiating elements, each of the at least first pair of elongate radiating elements comprising a first radiating element and a second radiating element, each radiating element having a feed end and a distal end; and the first and second radiating elements of each of the at least first pair of elongate radiating elements having their respective feed ends in juxtaposition relative to one another and extending in diverging relationship relative to one another in a direction towards their respective distal ends such that at points on a centre line between the first and second radiating elements, a ratio (b/a) of a transverse distance b between the first and second radiating elements through the point and a distance a from the feed ends to the point increases non-linearly in a direction towards the distal ends.

The ratio may increase non-linearly, for example exponentially.

A spine may be provided adjacent the feed ends of the radiating elements.

The antenna may comprise at least the first pair of radiating elements, a second pair of radiating elements and a third pair of radiating elements, the first pair of radiating elements, the second pair of radiating elements and the third pair of radiating elements may be oriented relative to the spine to be located in respective planes which extend parallel to one another.

Alternatively, the antenna may comprise at least the first pair of radiating elements, a second pair of radiating elements and a third pair of radiating elements, the first pair of radiating elements, the second pair of radiating elements and the third pair of radiating elements are oriented relative to the spine to be located in respective planes which are diverging away from one another in a direction away from the spine.

At least the first radiating element of at least one pair of the at least first pair of elongate radiating elements may be removably mountable on the spine.

Said first radiating element at the feed end thereof may comprise a formation configured to cooperate with a cooperating formation on the spine collectively to effect said diverging relationship with the second radiating element of said at least one pair and said orientation of said at least one pair relative to the spine.

The formation at the feed end of said first radiating element may be formed integrally with said first radiating element and the cooperating formation may be formed integrally with the spine.

In some embodiments, all the radiating elements of the at least first pair of elongate radiating elements may be identical in shape and configuration.

Further according to the invention, at least one of a) the spine and b) at least one radiating element may be manipulatable between a collapsed configuration and an operative configuration.

For example, the at least one radiating element may comprise a first segment and at least a second separate segment and the at least second separate segment may be removably connectable to the first segment in an end to end relationship.

In other embodiments, the at least one radiating element may comprise a first segment and at least a second segment which is permanently connected to the first segment and the first segment and at least second segment may be manipulatable between the collapsed configuration and the operative configuration.

In still other embodiments, the at least one radiating element may be resiliently flexible along at least part of its length and biased towards the operative configuration, which may be curved.

Also included within the scope of the present invention is a kit for assembling an antenna as herein defined and/or described.

Further included within the scope of the present invention is a spine for an antenna comprising at least one spine part and at least one formation on the spine part to effect collectively with a formation on a first radiating element of a pair of elongate radiating elements of the antenna an orientation of the pair of elongate radiating elements in a plane relative to the spine.

Still further included within the scope of the present invention is a radiating element for an antenna which is manipulatable between a collapsed configuration and an operative configuration.

BRIEF DESCRIPTION OF THE ACCOMPANYING DIAGRAMS

The invention will now further be described, by way of example only, with reference to the accompanying diagrams wherein.

DESCRIPTION OF A PREFERRED EMBODIMENT OF THE INVENTION

Figure 1:
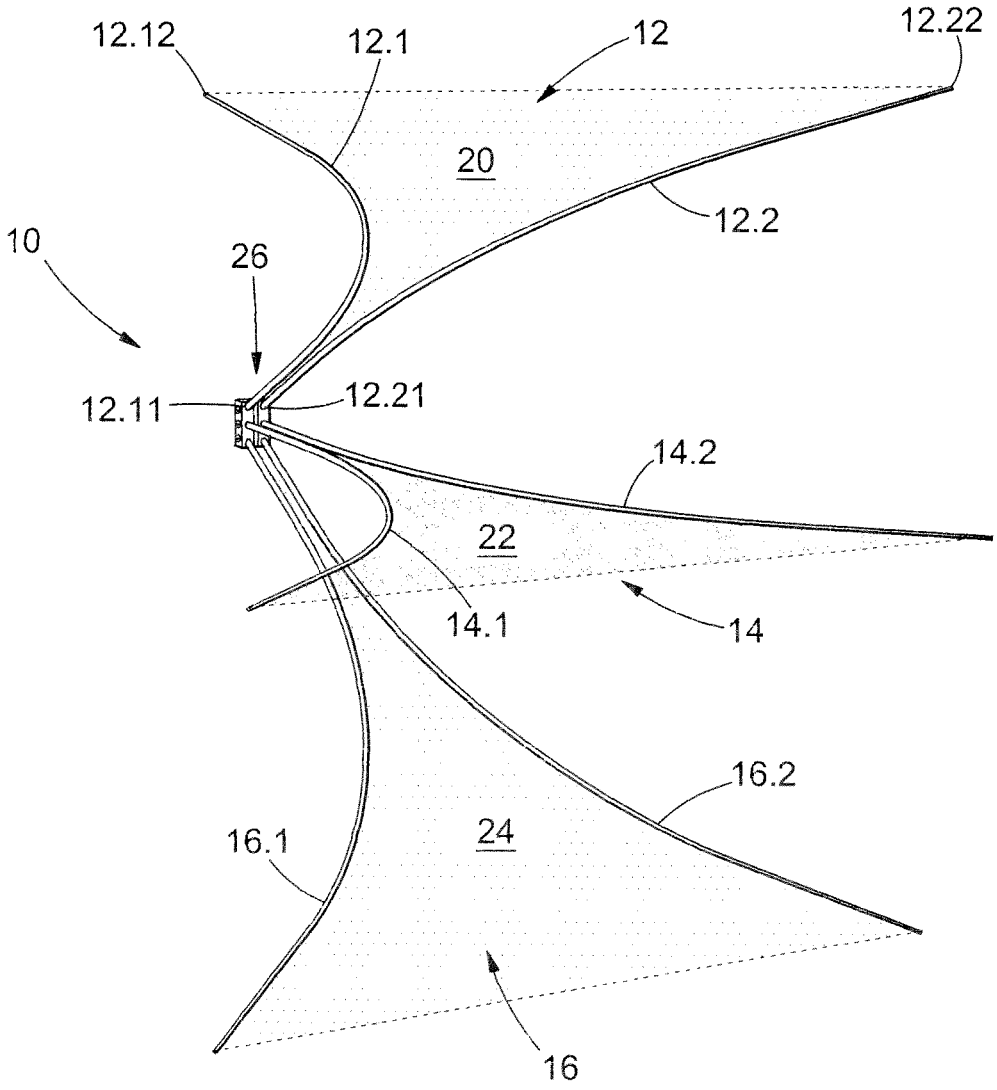
FIG. 1 is a diagrammatic perspective view of an example embodiment of an antenna.

An example embodiment of an antenna is generally designated by the reference numeral 10 in FIGS. 1, 2, 3 and 6. The antenna may typically, but not exclusively, be used for receiving television broadcasts at a user site or premises.

Figure 2:
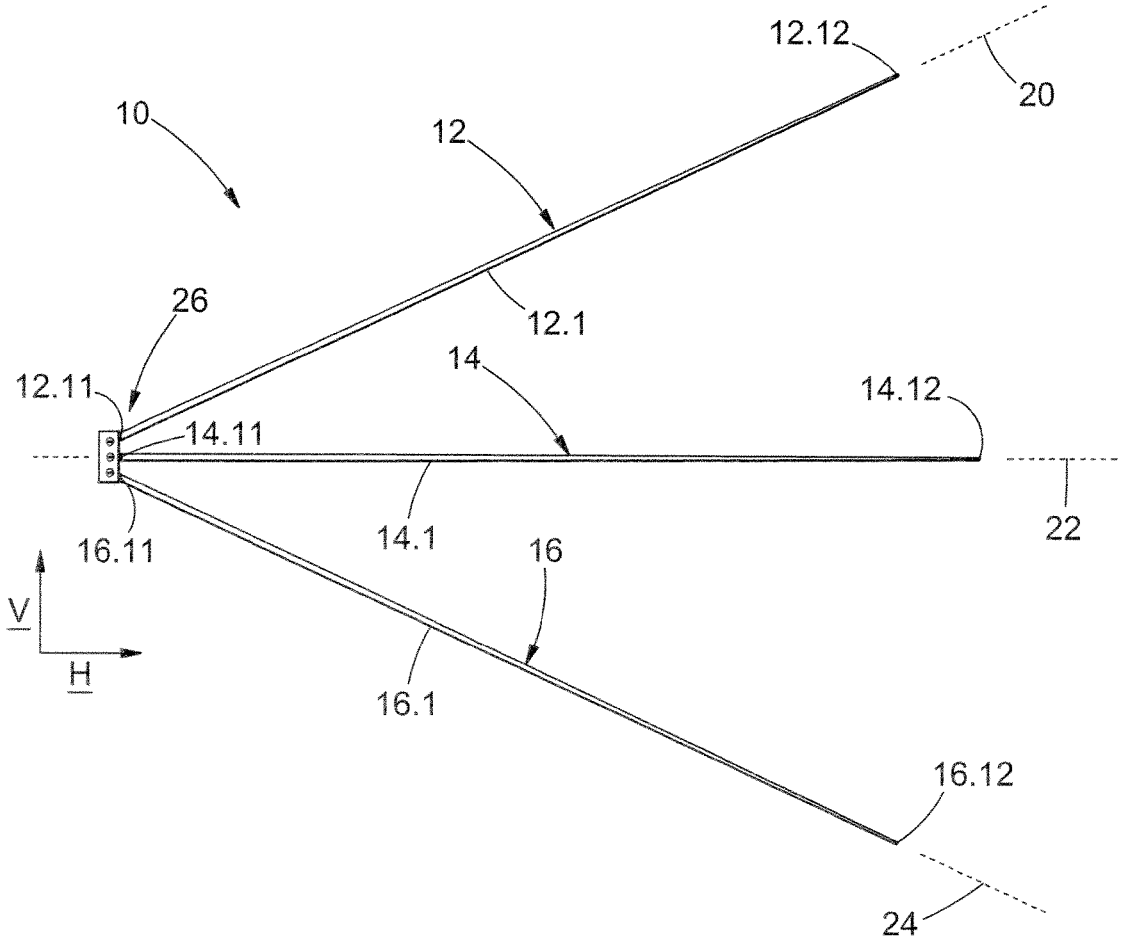
FIG. 2 is a side view of the antenna in FIG. 1.

The example embodiment of antenna 10 comprises at least a first pair 12 of elongate radiating elements and a second pair 14 of elongate radiating elements. The pairs are similar and hence only first pair 12 will be described in further detail. Pair 12 comprises a first radiating element 12.1 and a second radiating element 12.2. The elements are similar in configuration and hence only element 12.1 will be described in further detail. Element 12.1 has a feed end 12.11 and a distal or free end 12.12. The first and second radiating elements 12.1 and 12.2 of each of the at least first pair 12 and the second pair 14 have their respective feed ends 12.11, 12.21 in juxtaposition relative to one another and extend in diverging relationship away from one another in a direction from their respective feed ends 12.11, 12.21 towards their respective distal ends 12.12, 12.22. The at least first pair 12 and second pair 14 are electrically connected in parallel. As best shown in FIGS. 1 and 2, the example embodiment of the antenna 10 comprises a similar third pair 16 of radiating elements 16.1 and 16.2 connected in parallel with the first pair 12 and the second pair 14.

As best shown in FIG. 2, the first pair 12 of elements are located in a first plane 20, the second pair 14 of elements are located in a second plane 22 and the third pair 16 of elements are located in a third plane 24. The first plane 20, the second plane 22 and the third plane 24 are diverging away from one another from a spine 26 in a feed region of the antenna comprising the respective feed ends of the elements in a direction away from the spine. In other embodiments (not shown) the planes 20, 22 and 24 may extend parallel to one another.

Figure 3:
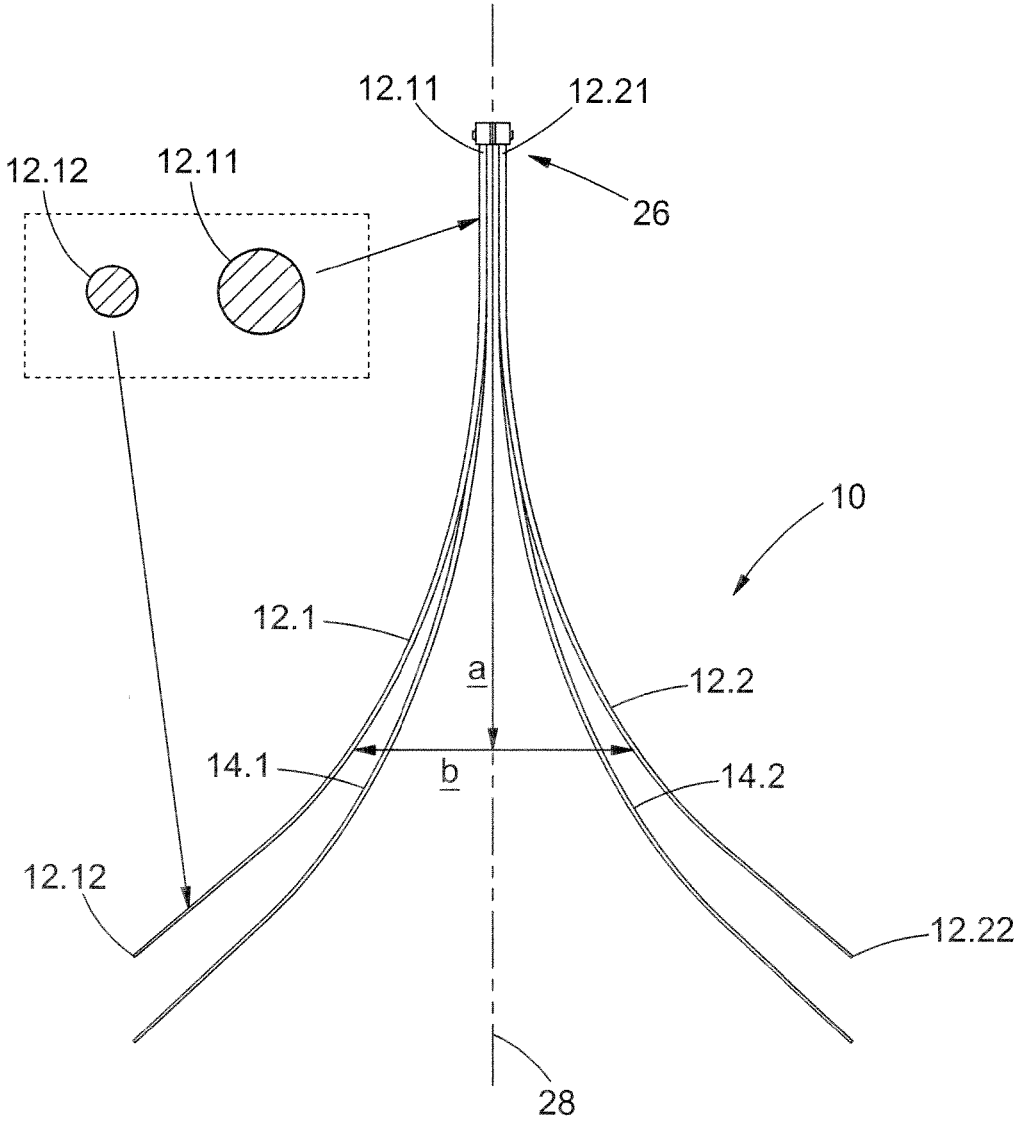
FIG. 3 is a plan view of the antenna in FIG. 1.

As best shown in FIG. 3, in the example embodiment, the radiating elements 12.1 and 12.2 extend in diverging relationship from one another such that at points on a centre line 28 between the radiating elements, a ratio (b/a) of a transverse distance b between the elements through the point and a distance a from the feed ends 12.11, 12.21 to the point increases non-linearly in an axial direction away from the feed ends. Preferably, the ratio increases exponentially.

As is illustrated by the enlarged transverse sectional views in the rectangle in broken lines in FIG. 3, the transverse cross section of each element is less towards the distal end 12.12 thereof than towards the feed end 12.11 thereof. The transverse cross section may decrease from the feed end 12.11 continuously towards the distal end 12.12, alternatively it may decrease in step-wise manner at least once, alternatively more than once along the length of the element.

The radiating elements are made from any suitable conductive material, such as aluminium.

Figure 4:
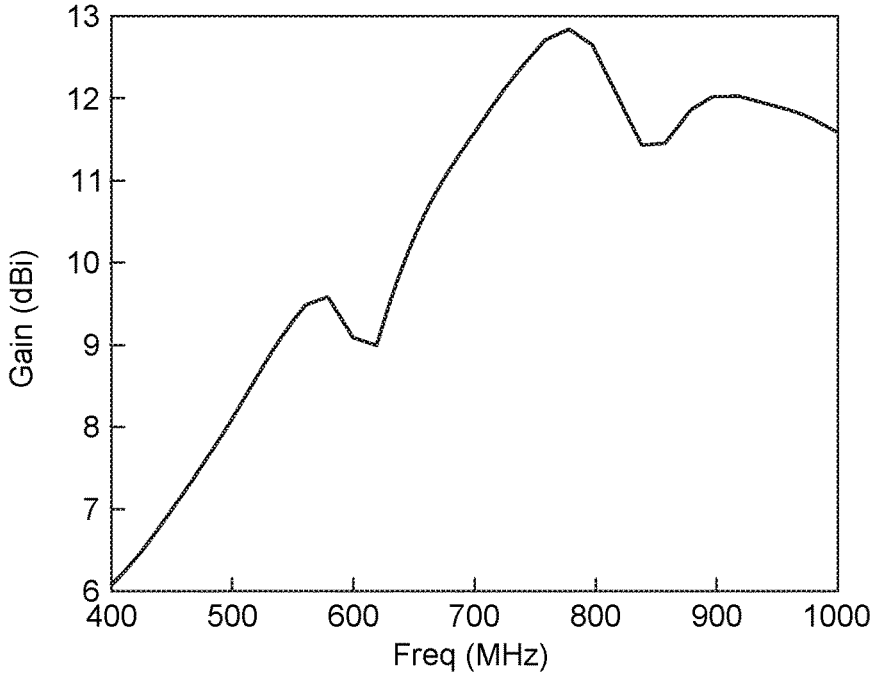
FIG. 4 is a graph of antenna gain against frequency for the antenna.
Figure 5:
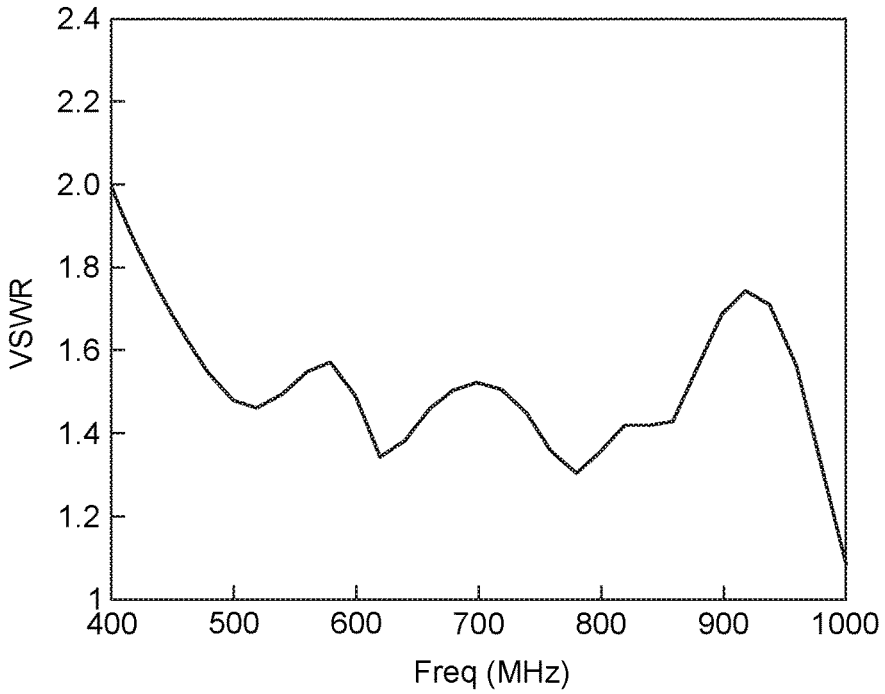
FIG. 5 is a graph of antenna VSWR against frequency for the antenna.

In FIGS. 4 and 5 there are shown self explanatory graphs of respectively antenna gain and VSWR against frequency. The measurements are shown for an antenna 10 which is mounted with reference to the horizontal H and vertical V as shown in FIG. 2 and on the centre line 28 (shown in FIG. 3) in plane 22 (shown in FIG. 2).

Figure 6:
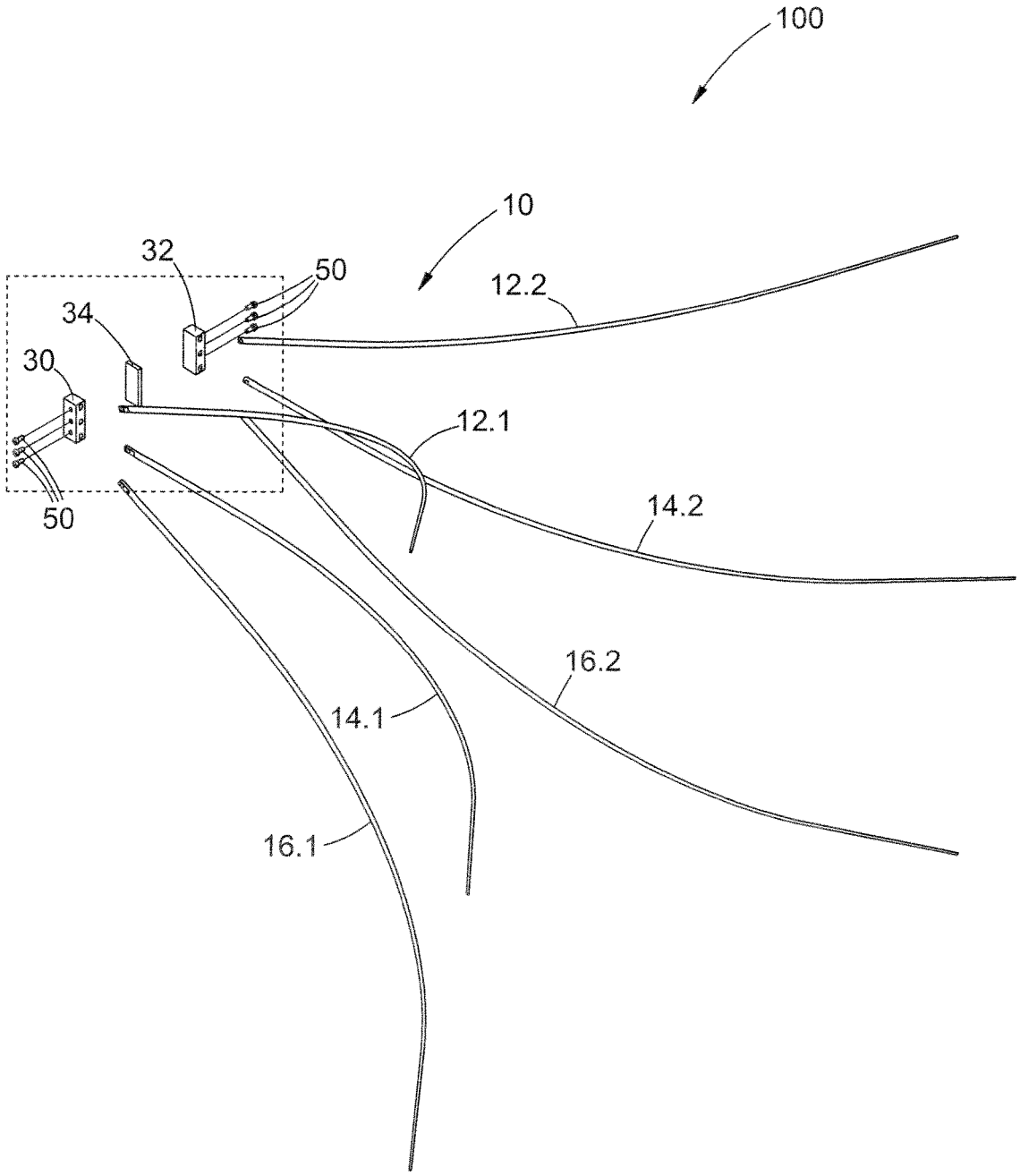
FIG. 6 is a diagrammatic exploded perspective view of the antenna or a kit for assembling the antenna.
Figure 7:
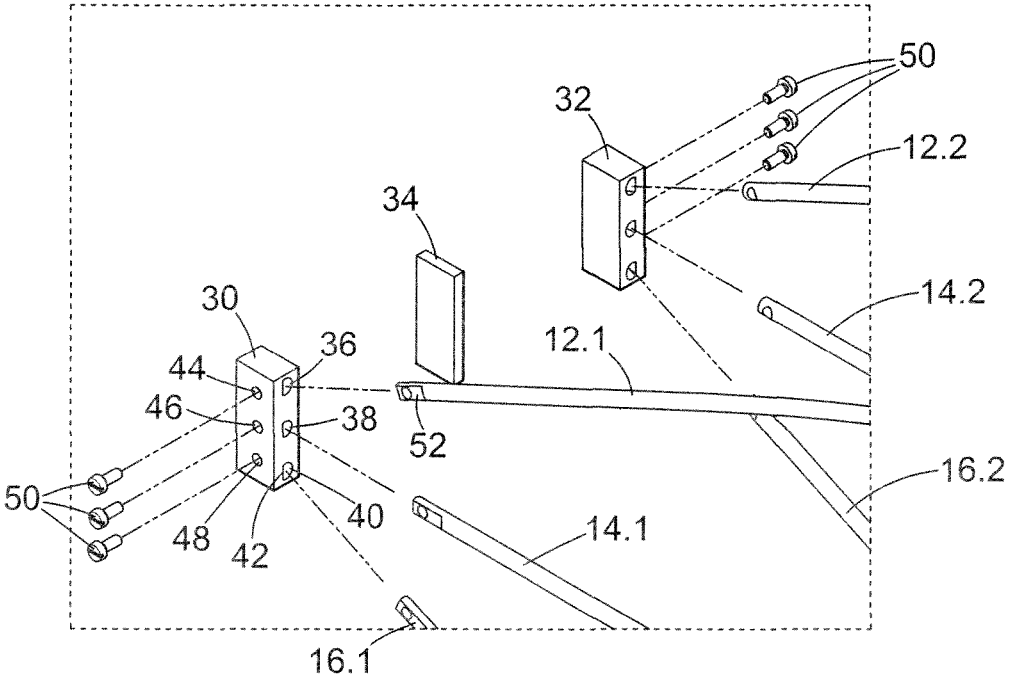
FIG. 7 is a diagrammatic perspective enlarged view of part of the kit in FIG. 6.

In FIGS. 6 and 7 there is a shown an example embodiment of a kit 100 for assembling the antenna 10.

The kit comprises a plurality of elongate radiating elements 12.1, 12.2, 14.1, 14.2, 16.1 and 16.2 of aluminium and of a curved configuration as herein defined and/or described. The kit comprises a first spine part or block 30 of an electrically conductive material, such as aluminium, and a second identical spine part or block 32 for assembling the spine 26 of the antenna. Since the blocks 30 and 32 are identical, only block 30 will be described herein further, insofar as it may be necessary. The kit further comprises a spacer 34 of an electrically isolating material for use between the first and second blocks.

As best shown in FIG. 7, the block 30 comprises integral formations—and in this example embodiment in the form of holes 36, 38 and 40 in a linear array. It will be appreciated that any other suitable formation may be used. Each formation or hole is configured for removably receiving a feed end of a respective radiating element 12.1, 14.1 and 16.1 and for holding the received element in a desired orientation (in azimuth and elevation) relative to the block and hence the spine. In the example embodiment shown, the hole is generally circular in transverse cross section with part of a sidewall thereof flattened as shown at 42. The flattening of the sidewall ensures that a curved elongate element with an integral and cooperating formation at the feed end is by necessity inserted into the hole with the correct angle relative to its own center axis such that both orientation of a pair of radiating relative to the spine and direction of curvature of the radiating element is uniquely defined even if all radiating elements are identical. The block 30 further defines transversely extending threaded holes 44, 46 and 48 for receiving tightening bolts or screws 50.

The integral cooperating formation towards the feed end 12.11 of each radiating element is configured to have a shape complementary to that of the receiving hole in that it has the same, but slightly smaller transverse cross section as the receiving hole 36. Hence, the region is generally circular in transverse cross section with part of a sidewall thereof flattened as shown at 52.

Referring to FIGS. 6 and 7, in use, the first and second blocks 30 and 32 with the spacer 34 sandwiched between them are assembled together to form the spine 26 for the antenna which then constitutes the aforementioned feed region. The respective feed ends of identical radiating elements 12.1, 12.2, 14.1, 14.2, 16.1 and 16.2 are pushed into the aforementioned holes in the blocks 30 and 32. As stated hereinbefore, the cooperating integral formations on the spine and the radiating elements are configured collectively to effect and ensure that the pairs of radiating elements are held by the spine in the diverging planes 20, 22 and 24 shown in FIG. 2, alternatively in parallel planes (not shown) as the case may be and with the respective radiating elements of each pair in the diverging relationship, for example as shown in FIG. 3. The radiating elements are secured to the blocks by the bolts 50 cooperating with the treaded transverse holes.

It will be appreciated that there are many variations in detail on the antenna and kit without departing from the scope and spirit of this disclosure. For example, the antenna may be scalable in terms of frequency band and the number of pairs of radiating elements.

Furthermore, the spine serves to hold each radiating element to extend in a desired direction from the spine and at a desired angle relative to the spine and the other elongate radiating elements forming part of the antenna. Hence, the spine incorporates means to ensure a desired rotational angle of each elongate radiating element, such that the desired shape and/or configuration in three-dimensions is necessarily achieved upon assembly. The spine therefore comprises means to define the starting direction of each radiating element and also means to determine the rotational angle of each element with respect to its own centre axis, such that when the radiating elements are secured to the spine of the antenna, the antenna shape and/or configuration is necessarily formed.

Figure 8:
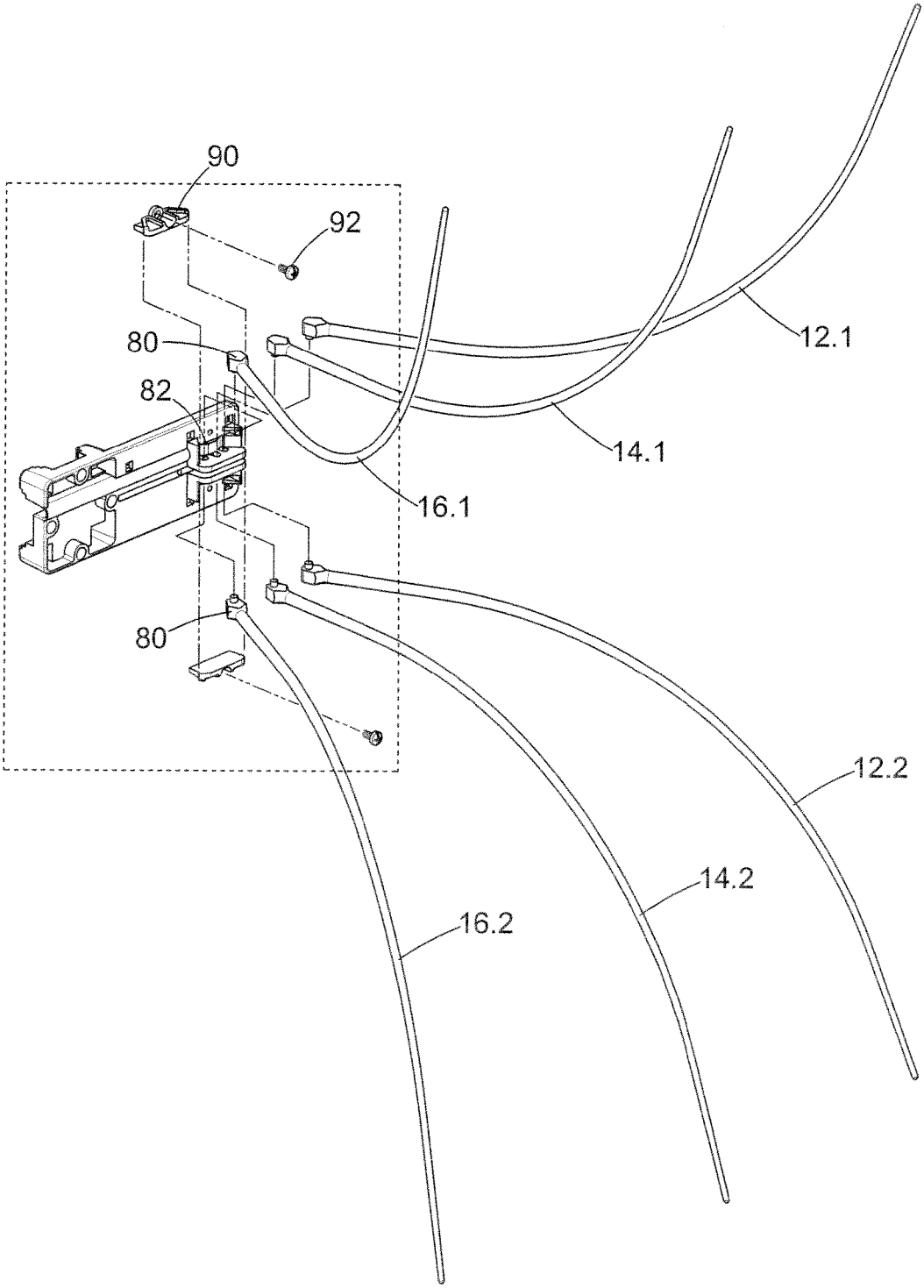
FIG. 8 is a diagrammatic exploded perspective view of another example embodiment of the antenna or a kit for assembling the antenna.
Figure 9:
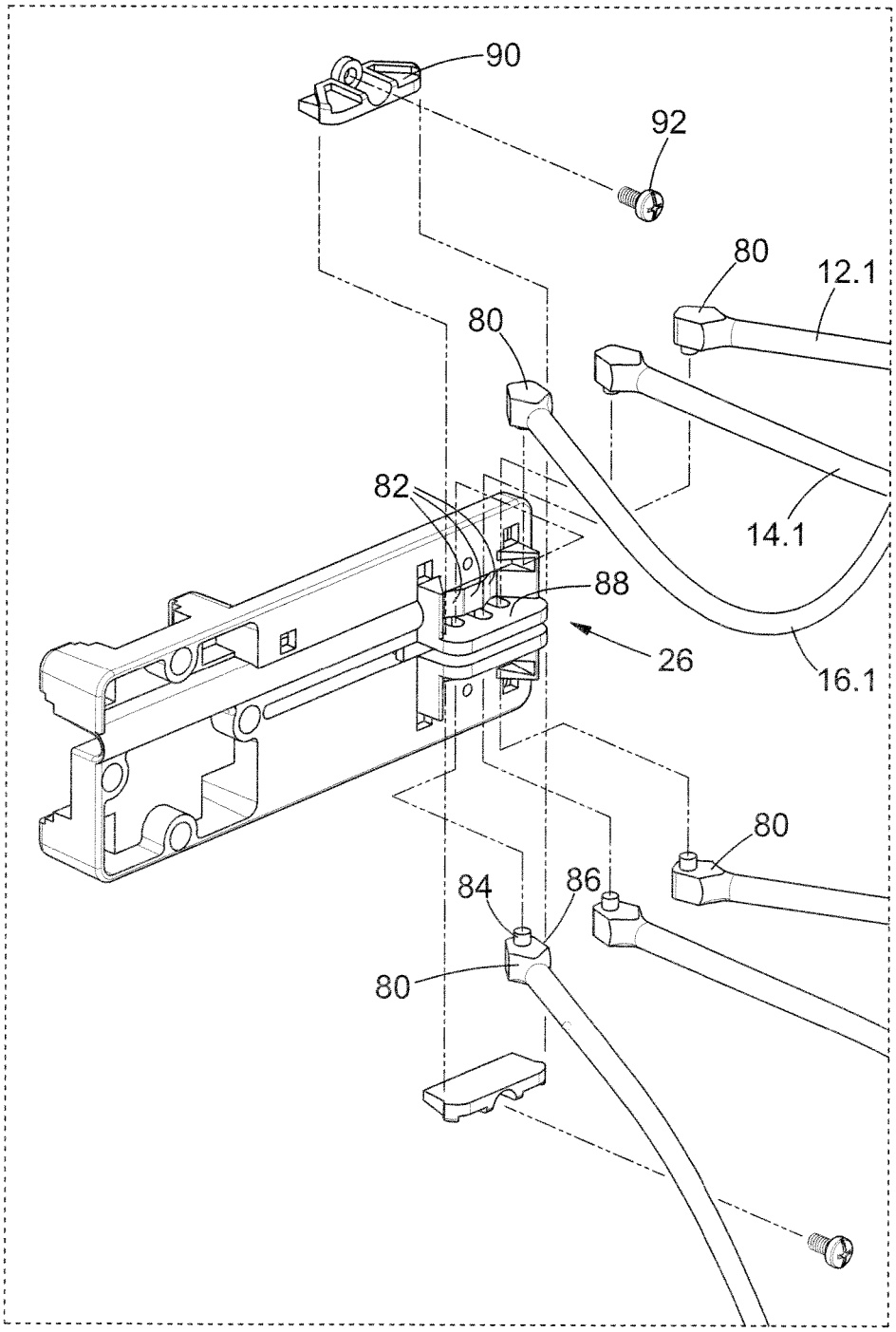
FIG. 9 is a diagrammatic perspective enlarged view of part of the kit in FIG. 8.

In FIGS. 8 and 9 there are shown another embodiment of the antenna comprising identical radiating elements 12.1, 12.2, 14.1, 14.2, 16.1 and 16.2. Each element comprises a respective integral locating formation comprising a head 80 at its feed end for cooperating with a cooperating formation 82 which is integrally formed with the spine 26, to effect the desired orientation of the pairs of elements relative to the spine and the diverging relationship as hereinbefore described. Each formation further comprises a transverse spigot 84 and profiled sides 86 of the head. The sides 86 of the head abut and cooperate with the cooperating formations 82 on the spine. The juxtaposed feed ends of the radiating elements are removably secured to the spine by sandwiching them between integral ledge 88 on spine 26 and a separate plate 90 which is removably securable to the spine by a screw 92.

As stated hereinbefore, all the radiating elements may be identical in shape and/or configuration so that any element may be used in any position on the spine.

Furthermore, to facilitate packaging in a container or box with a small form factor, the antenna may be provided and transported in at least a partially collapsed or knocked-down configuration and then assembled or deployed at the user site.

As described above, to reduce packaging space required, the spine may comprise at least two parts that may be assembled and/or manipulated to an operative configuration of the spine. The parts may be separate parts or may be hinged or otherwise connected or connectable to one another. The hinges or connections may be biased by springs or otherwise to the operative configuration, so that when packaging constraints are removed, the spine parts, under the influence of the bias, may automatically adopt the operative configuration. In some embodiments, each spine part may have permanently mounted thereon at least one radiating element. In other embodiments and as above described, at least some of the radiating elements, and even all the radiating elements are removably securable to the spine or spine parts.

Figure 10:
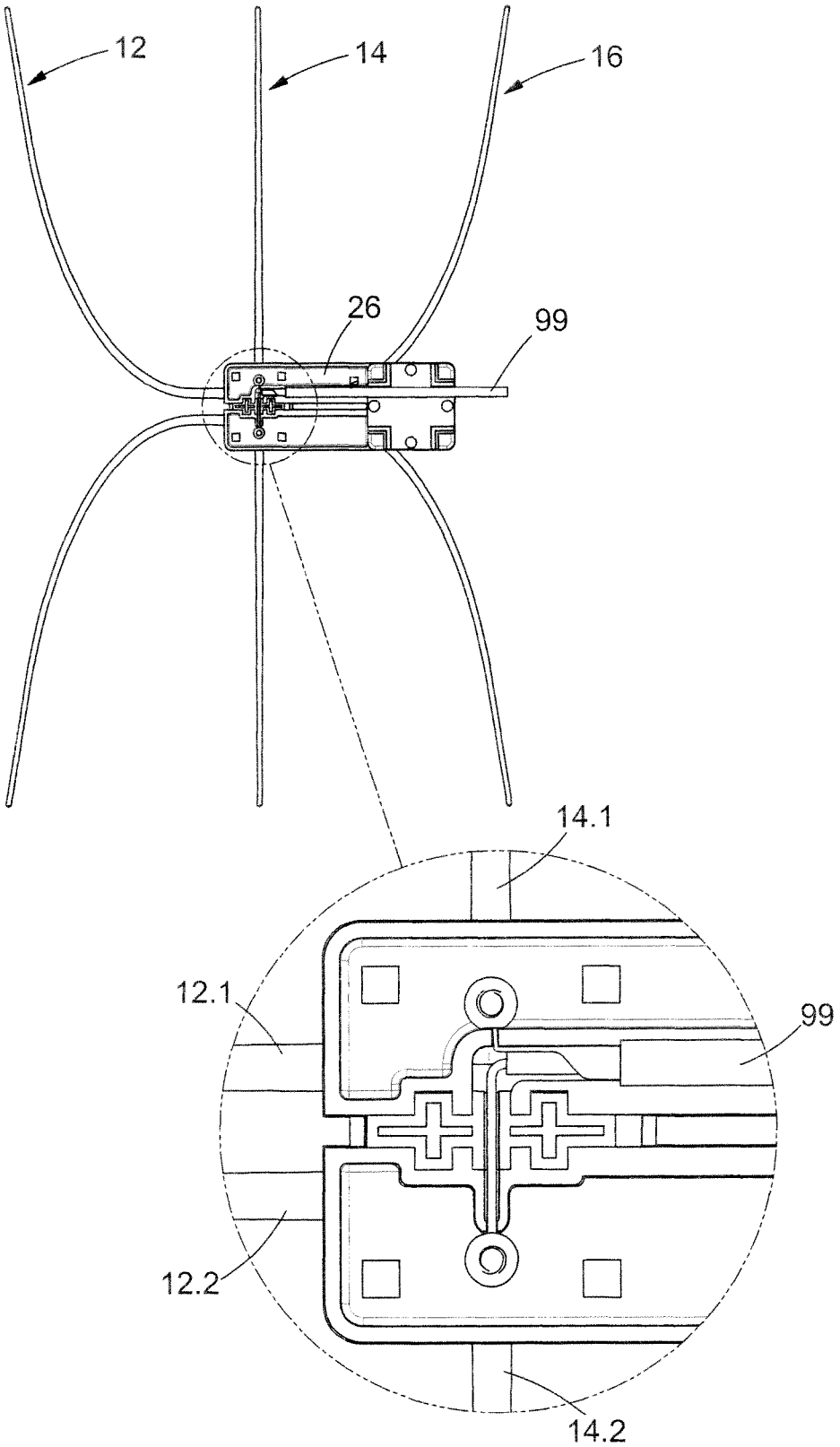
FIG. 10 is an enlarged rear view illustrating electrical connection of radiating elements of the antenna.

In FIG. 10 there is a self explanatory diagram illustrating the electrical connection of the first, second and third pairs 12, 14 and 16 in parallel with one another and to a coaxial cable 99.

At least one and in some embodiments all the radiating element may be manipulatable between a first and collapsed configuration and a second and operative configuration.

Figure 11:
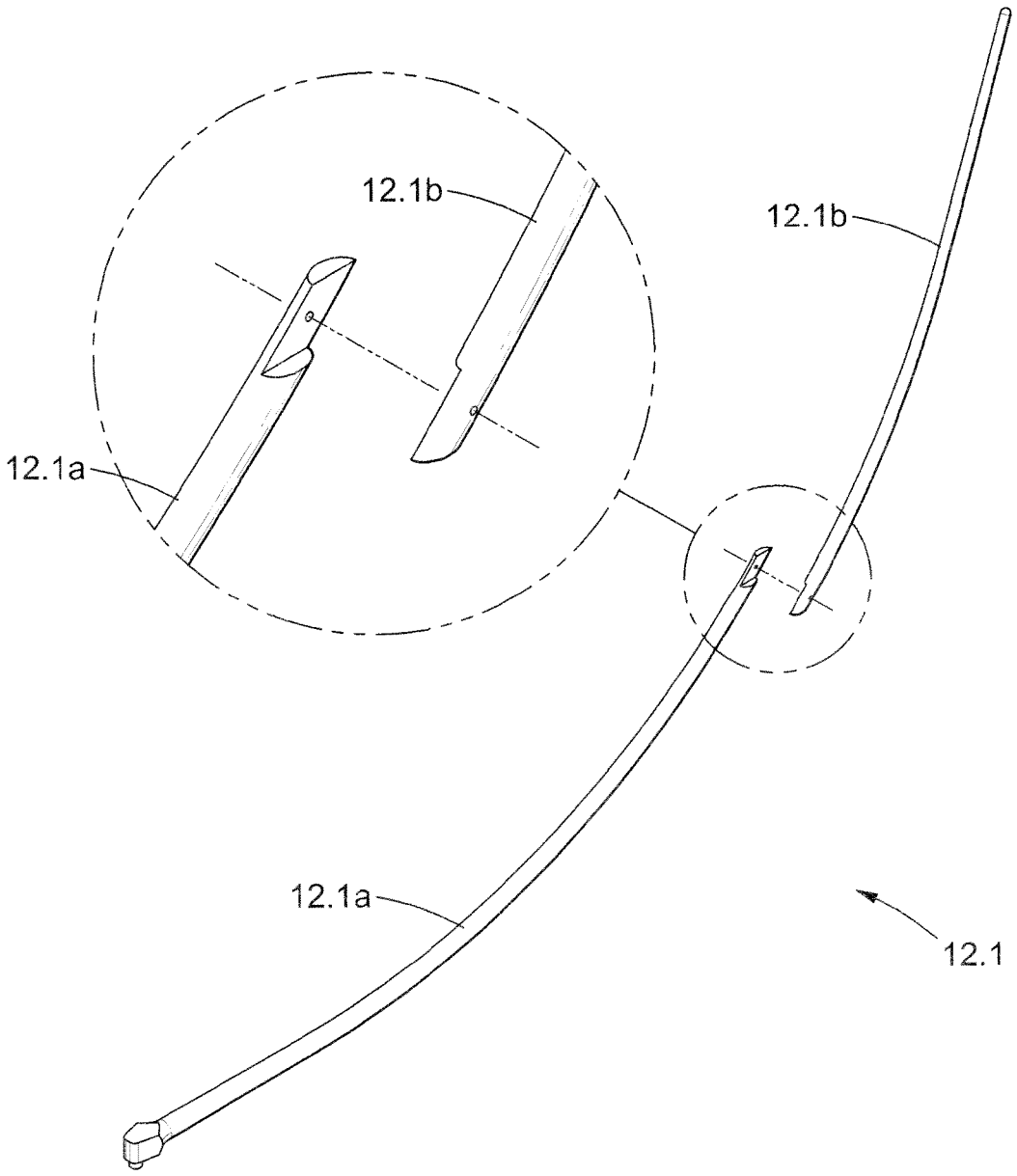
FIG. 11 is a diagrammatic perspective view of one example embodiment of a radiating element of the antenna.

In one embodiment and as shown in FIG. 11, each radiating element 12.1 may comprise a first segment 12.1*a* and at least a second separate segment 12.1*b* which is removably connectable to the first segment in an end to end relationship.

Figure 12:
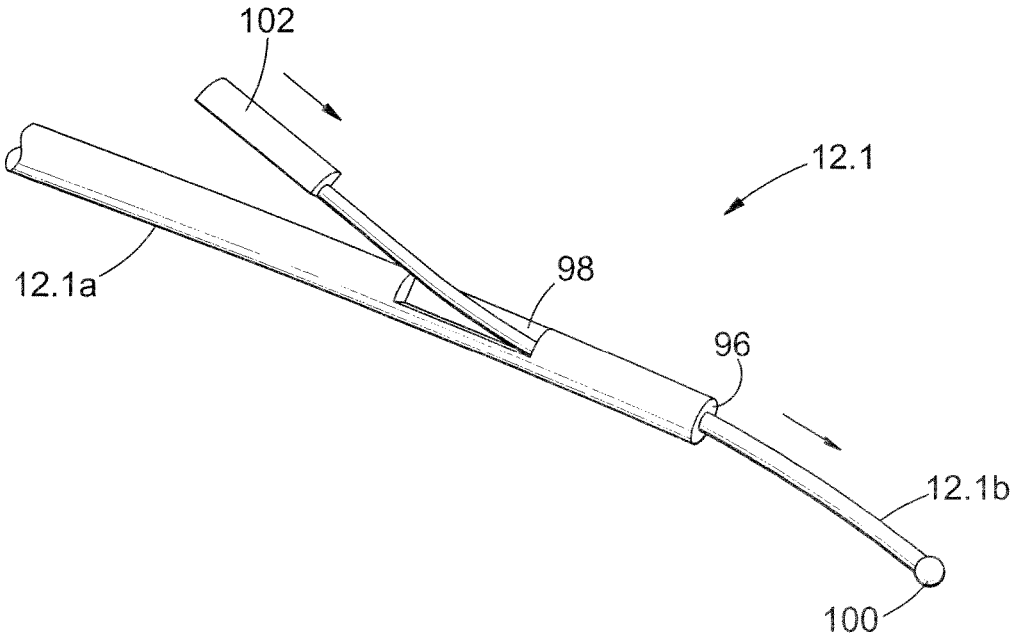
FIG. 12 is a diagrammatic perspective view of another example embodiment of a radiating element of the antenna.

In other embodiments, each radiating element 12.1 may comprise a first segment and at least a second segment permanently connected to the first segment and manipulatable between a first and collapsed configuration and a second and operative configuration. For example and as shown in FIG. 12, the first segment 12.1*a* may define a central bore 96 towards its free end which bore communicates with a cavity 98 in a sidewall thereof. The second segment 12.1*b* may comprise a length of wire or the like which comprises a handle 100 at a distal end thereof and a stopper 102 at the opposite end thereof. The second segment is manipulatable between the collapsed configuration as shown in FIG. 12 and the operative configuration (not shown) wherein the second segment is manually extended so that the stopper 102 seats in the cavity 98.

In other embodiments, the first segment and at least second segment may be telescopically connected to one another and telescopically manipulatable relative to one another. In still other embodiments, the first and at least second segment may be hinged in end to end relationship relative to one another. The hinge may be biased towards the operative configuration of the segments and hence radiating element.

In still other embodiments each radiating element may be of unitary construction, resiliently flexible along at least part of its length, preferably towards the feed end thereof, and biased towards an operative curved configuration. Hence, for packaging purposes, the elements may manually be straightened. When the packaging constraints are removed, the elements, under the influence of the bias, may automatically adopt the normal and operative curved configuration. This embodiment may also make the antenna more resilient to external forces.

The antenna may also find application in many other and diverse applications, such as cellular communications and military communications wherein the expected features of broad bandwidth, relatively simple deployment and/or collapsibility and improved packaging volume of the antenna may be advantageous.

The invention claimed is:

1. An antenna comprising:

at least a first pair of elongate radiating elements and a second pair of elongate radiating elements, each pair of elongate radiating elements comprising a first radiating element and a second radiating element, each radiating element having a feed end and a distal end;

the first and second radiating elements of each of the at least first pair of elongate radiating elements and second pair of elongate radiating elements having their respective feed ends in juxtaposition relative to one another and being curved to extend in diverging relationship relative to one another on either side of a respective axis of symmetry in a direction from their respective feed ends towards their respective distal ends, such that at points on the respective axis of symmetry between the first and second radiating elements, a ratio (b/a) of a transverse distance b between the first and second radiating elements through the point and a distance a from the feed ends to the point, increases non-linearly in a direction towards the distal ends; and the at least first pair of elongate radiating elements and second pair of elongate radiating elements being electrically connected in parallel and being respectively located, together with the respective axis of symmetry, in at least a first plane and a second plane respectively, the at least first and second planes diverging away from one another from the feed ends so that the respective axes of symmetry also diverge away from one another from the feed ends.

2. The antenna as claimed in claim 1 further comprising a spine adjacent to the feed ends of the radiating elements.

3. The antenna as claimed in claim 2, wherein at least the first radiating element of at least one pair of the at least first pair of elongate radiating elements and second pair of radiating elements is removably mountable on the spine.

4. The antenna as claimed in claim 3, wherein said first radiating element at the feed end thereof comprises a formation configured to cooperate with a cooperating formation on the spine collectively to effect said diverging relationship with the second radiating element of said at least one pair of radiating elements and said location of said at least one pair of radiating elements in said respective plane.

5. The antenna as claimed in claim 4, wherein the formation at the feed end of said first radiating element is integrally formed with said first radiating element and wherein the cooperating formation is integrally formed with the spine.

6. The antenna as claimed in claim 1, wherein all the radiating elements of the at least first pair of radiating elements and second pair of radiating elements are identical in shape and configuration.

7. The antenna as claimed in claim 1, wherein at least one of a) the spine and b) at least one radiating element is manipulatable between a collapsed configuration and an operative configuration.

8. The antenna as claimed in claim 7, wherein the at least one radiating element comprises a first segment and at least a second separate segment and wherein the at least second separate segment is removably connectable to the first segment in an end to end relationship.

9. The antenna as claimed in claim 7, wherein the at least one radiating element comprises a first segment and at least a second segment which is permanently connected to the first segment and wherein the first segment and the at least second segment are manipulatable between the collapsed configuration and the operative configuration.

10. The antenna as claimed in claim 7 wherein the at least one radiating element is resiliently flexible along at least part of its length and biased towards the operative configuration which is curved.

11. The antenna as claimed in claim 1, wherein the ratio increases exponentially.

12. The antenna as claimed in claim 1 comprising three pairs of elongate radiating elements located in the first, the second and a third plane respectively, and which planes diverge away from one another from the feed ends so that the respective axes of symmetry in each of the first, second and third planes also diverge away from one another from the feed ends.

13. The antenna as claimed in claim 1 wherein a transverse cross section of each radiating element is less towards the distal end thereof than towards the proximate end thereof.

14. The antenna as claimed in claim 1 further comprising a spine adjacent to the feed ends of the radiating elements, the spine comprising a first electrically conductive part and a second electrically conductive part, the second part being electrically isolated from the first part, wherein the respective feed ends of the first radiating elements of each of the at least first pair of elongate radiating elements and the second pair of elongate radiating elements are mountable on the first part of the spine, and wherein the respective feed ends of the second radiating elements of each of the at least first pair of elongate radiating elements and the second pair of elongate radiating elements are mountable on the second part of the spine.

15. The antenna as claimed in claim 14, wherein the feed end of at least the first radiating element of the first pair of elongate radiating elements is removably mountable on the first part of the spine.

16. The antenna as claimed in claim 15, wherein said first radiating element at the feed end thereof comprises a formation configured to cooperate with a cooperating formation on the first part of the spine collectively to effect said diverging relationship with the second radiating element of said first pair of radiating elements and said location of said first pair of radiating elements in said first plane.

17. The antenna as claimed in claim 16, wherein the formation at the feed end of said first radiating element is integrally formed with said first radiating element and wherein the cooperating formation is integrally formed with the first part of the spine.

18. The antenna as claimed in claim 14 wherein the respective feed ends of the first radiating elements of each of the at least first pair of radiating elements and second pair of radiating elements are mountable on the first part of the spine in a first linear array and wherein the respective feed ends of the second radiating elements of each of the at least first pair of radiating elements and second pair of radiating elements are mountable on the second part of the spine in a second linear array and wherein the first linear array and the second linear array are parallel to one another.

19. The antenna as claimed in claim 1 further comprising a spine adjacent the feed ends of the radiating elements, the spine comprising a first electrically conductive part and a second electrically conductive part and which second part is electrically isolated from the first part, wherein the respective feed ends of the first radiating elements of each of the at least first pair of elongate radiating elements and the second pair of elongate radiating elements are mounted on the first part of the spine and the respective feed ends of the second radiating elements of each of the at least first pair of elongate radiating elements and the second pair of elongate radiating elements are mounted on the second part of the spine.

* * * * *